US012077901B2

(12) United States Patent
Yoon et al.

(10) Patent No.: US 12,077,901 B2
(45) Date of Patent: Sep. 3, 2024

(54) CLOTHING TREATMENT APPARATUS

(71) Applicant: Samsung Electronics Co., Ltd., Suwon-si (KR)

(72) Inventors: Kwonchul Yoon, Suwon-si (KR); Jaeryong Park, Suwon-si (KR); Heetae Lim, Suwon-si (KR); Euiyoung Chang, Suwon-si (KR); Taegwang Kim, Suwon-si (KR); Yongjoon Jang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 696 days.

(21) Appl. No.: 17/250,861

(22) PCT Filed: Feb. 21, 2019

(86) PCT No.: PCT/KR2019/002156
§ 371 (c)(1),
(2) Date: Mar. 12, 2021

(87) PCT Pub. No.: WO2020/054930
PCT Pub. Date: Mar. 19, 2020

(65) Prior Publication Data

US 2022/0056632 A1 Feb. 24, 2022

(30) Foreign Application Priority Data

Sep. 14, 2018 (KR) ..... 10-2018-0110204
Feb. 21, 2019 (KR) ..... 10-2019-0020542

(51) Int. Cl.
*D06F 73/02* (2006.01)
*D06F 35/00* (2006.01)

(52) U.S. Cl.
CPC ..... *D06F 73/02* (2013.01); *D06F 35/00* (2013.01)

(58) Field of Classification Search
CPC ..... D06F 73/02; D06F 35/00
(Continued)

(56) References Cited

U.S. PATENT DOCUMENTS 408,690 A * 8/1889 Burton et al. ..... D06F 21/02 251/114
2,703,973 A * 3/1955 Fawcett ..... D06F 73/02 223/51
(Continued)

FOREIGN PATENT DOCUMENTS

DE 102008035377 A1 * 2/2009 ..... D06F 58/10
EP 327041 A * 8/1989 ..... A47K 4/00
(Continued)

OTHER PUBLICATIONS

International Search Report and Written Opinion of the International Searching Authority in connection with International Application No. PCT/KR2019-002156 dated Jun. 11, 2019, 14 pages.
(Continued)

*Primary Examiner* — Stephen M Gravini

(57) ABSTRACT

A clothing treatment apparatus according to the present disclosure may comprise: a body including a receiving chamber disposed therein to receive clothing; a door for opening or closing the body; a spraying member for spraying steam toward the clothing; and a steam generator for supplying steam to the spraying member, wherein the receiving chamber may include a discharge port through which condensate water generated inside the receiving chamber is discharged, and a flow path through which the condensate water flows to the discharge port.

15 Claims, 11 Drawing Sheets

(58) Field of Classification Search
USPC ..... 34/210
See application file for complete search history.

(56) References Cited

U.S. PATENT DOCUMENTS

| | | | | |
|---|---|---|---|---|
| 3,049,903 | A * | 8/1962 | Sussman | D06F 87/00 68/12.26 |
| 5,094,020 | A * | 3/1992 | Wingfield | D06F 73/02 223/51 |
| 8,132,339 | B2 * | 3/2012 | Moon | D06F 58/10 8/158 |
| 8,539,694 | B2 * | 9/2013 | Moon | D06F 58/20 8/149.1 |
| 9,745,682 | B2 * | 8/2017 | Park | D06F 29/00 |
| 9,809,924 | B2 | 11/2017 | Park et al. | |
| 9,938,657 | B2 | 4/2018 | Yoon et al. | |
| 10,329,081 | B2 * | 6/2019 | Nam | F24F 13/20 |
| 11,168,438 | B2 * | 11/2021 | Kim | D06F 58/10 |
| 2009/0126414 | A1 | 5/2009 | Kim et al. | |
| 2010/0132130 | A1 | 6/2010 | Moon et al. | |
| 2022/0056632 | A1 * | 2/2022 | Yoon | D06F 73/02 |
| 2023/0287622 | A1 * | 9/2023 | Lee | D06F 58/206 |

FOREIGN PATENT DOCUMENTS

| | | | | |
|---|---|---|---|---|
| KR | 20090013983 | A * | 2/2009 | |
| KR | 10-2009-0069755 | A | 7/2009 | |
| KR | 10-1155003 | B1 | 6/2012 | |
| KR | 10-1306714 | B1 | 9/2013 | |
| KR | 20-0472954 | Y1 | 5/2014 | |
| KR | 10-1430459 | B1 | 8/2014 | |
| KR | 10-1435810 | B1 | 8/2014 | |
| KR | 10-1435822 | B1 | 8/2014 | |
| KR | 10-1597106 | B1 | 3/2016 | |
| KR | 10-2016-0075032 | A | 6/2016 | |
| KR | 10-2017-0120533 | A | 10/2017 | |
| KR | 10-1821216 | B1 | 1/2018 | |
| WO | WO-2020054930 | A1 * | 3/2020 | D06F 35/00 |

OTHER PUBLICATIONS

Chang-Hoon, "Samsung AirDresser: Joining Competition in Clothing Care Device Market", Aug. 21, 2018, 2 pages.
"Samsung Showcases AirDresser, Joining in Market for Clothes Refresher", Aug. 21, 2018, 2 pages.
Jeon, ""Market of Clothing Care Systems Just Got Bigger". . . Samsung challenges LG", Aug. 21, 2018, 3 pages.
"Samsung Electronics Unveiled Clothes Cleaner "AirDresser" Aiming at LG Styler", The Korea Economic Daily, Aug. 21, 2018, 2 pages.
Request for the Submission of an Opinion dated Apr. 4, 2024, in connection with Korean Patent Application No. 10-2019-0020542, 8 pages.

* cited by examiner

CLOTHING TREATMENT APPARATUS

CROSS-REFERENCE TO RELATED APPLICATIONS

This application is a 371 National Stage of International Application No. PCT/KR2019/002156, filed Feb. 2, 2019, which claims priority to Korean Patent Application No. 10-2019-0020542, filed Feb. 21, 2019, and Korean Patent Application No. 10-2018-0110204, filed Sep. 14, 2018, the disclosures of which are herein incorporated by reference in their entirety.

BACKGROUND

1. Field

The disclosure relates to a clothing treatment apparatus for enhancing a state of clothing.

2. Description of Related Art

In general, a washing machine is widely used as an apparatus for washing products formed of fabric such as clothing or bedding, and the washing machine washes laundry through friction between wash water and laundry accommodated in a water tank, and accordingly, dehydration and drying processes and the like are additionally necessary.

In recent years, clothing treatment apparatuses which are apparatuses for treating and managing clothing more simply than the washing machine of the related art, and have functions of removing wrinkles from clothing or removing dust or odors of clothing without a separate washing process through wash water have been used.

The clothing treatment apparatus may remove odors, wrinkles, moisture, or the like remaining on clothing by spraying high-temperature steam to the clothing. In the clothing treatment apparatus, it is necessary to provide a water supply container for supplying water to a steam generator for generating steam and provide a drainage container for draining condensate water generated in the clothing treatment apparatus to outside.

SUMMARY

The disclosure provides a clothing treatment apparatus capable of preventing condensate water generated in an accommodation chamber of the clothing treatment apparatus from leaking to outside.

According to a clothing treatment apparatus according to an aspect of the disclosure, there is provided a clothing treatment apparatus including a main body configured to include an accommodation chamber for accommodation clothing, a door configured to open or close the main body, a spraying port configured to spray steam toward the clothing accommodated in the accommodation chamber, and a steam generator configured to supply steam to the spraying port, in which the accommodation chamber includes a flow path for guiding movement of condensate water generated in the accommodation chamber.

A discharge port for discharging the condensate water may be formed on a bottom surface of the accommodation chamber, and one end of the flow path may be connected to the discharge port.

The accommodation chamber may include a guide member disposed on a bottom of the accommodation chamber, and the guide member may be configured to guide the condensate water falling down along an inner side surface of the accommodation chamber to move to the discharge port.

The guide member may include a tilt surface tilting downwards to the discharge port; and a rib formed on a front surface of an upper portion of the tilt surface and formed to extend in a direction of the door.

The rib may be formed to protruded to an outer side surface of the main body.

The door may include a gasket configured to be disposed on an inner side surface of the door, and based on the door being closed, be overlapped with the rib to shield leakage of the condensate water.

The gasket, based on the door being closed, may be disposed on the door so as to surround the accommodation chamber.

The rib may include a first rib and a second rib formed to be protruded to a front surface of the tilt surface with heights different from each other.

The guide member may further include a shielding member disposed on one end of the tilt surface opposing the discharge port and formed to be protruded upwards from the tilt surface.

The shielding member may be disposed symmetrically on both side ends of the guide member.

The rib may be formed to extend from a front surface of the shielding member.

The door may further include a cover member formed to be protruded towards the accommodation chamber, and the cover member may guide condensate water falling down along an inner side surface of the door to move to the discharge port.

The cover member may include a drop part formed on a lower end in an undercut shape.

The cover member may further include a curved part which is formed on both ends of the cover member and tilts to the inside to guide the condensate water to the drop part.

The cover member may be formed to tilt downwards to the discharge port, based on the door being closed.

DETAILED DESCRIPTION

Hereinafter, embodiments of a clothing treatment apparatus of the disclosure will be described in detail with reference to the accompanying drawings.

The examples described below are exemplified for understanding of the disclosure and it should be understood that the disclosure may be modified and performed variously unlike in the examples described herein. However, in describing the disclosure, a detailed description of the related art or configuration may be omitted when it is determined that the detailed description may unnecessarily obscure a gist of the disclosure. In addition, the accompanying drawings may not be illustrated with actual scales but may be illustrated with enlarged dimensions of some elements, for the understanding of the disclosure.

The terms "first," "second," or the like may be used for describing various elements but the elements may not be limited by the terms. The terms are used only to distinguish one element from another. For example, a first element may be referred to as a second element and the second element may also be similarly referred to as the first element, while not departing from the scope of a right of the disclosure.

The terms used in the embodiments of the disclosure may be interpreted as meanings known to those skilled in the art, unless otherwise defined.

In addition, the terms a "front end", a "rear end", an "upper portion", a "lower portion", an "upper end", a "lower end", and the like are defined based on the drawings and these terms do not limit a shape and a position of each element.

Figure 1:
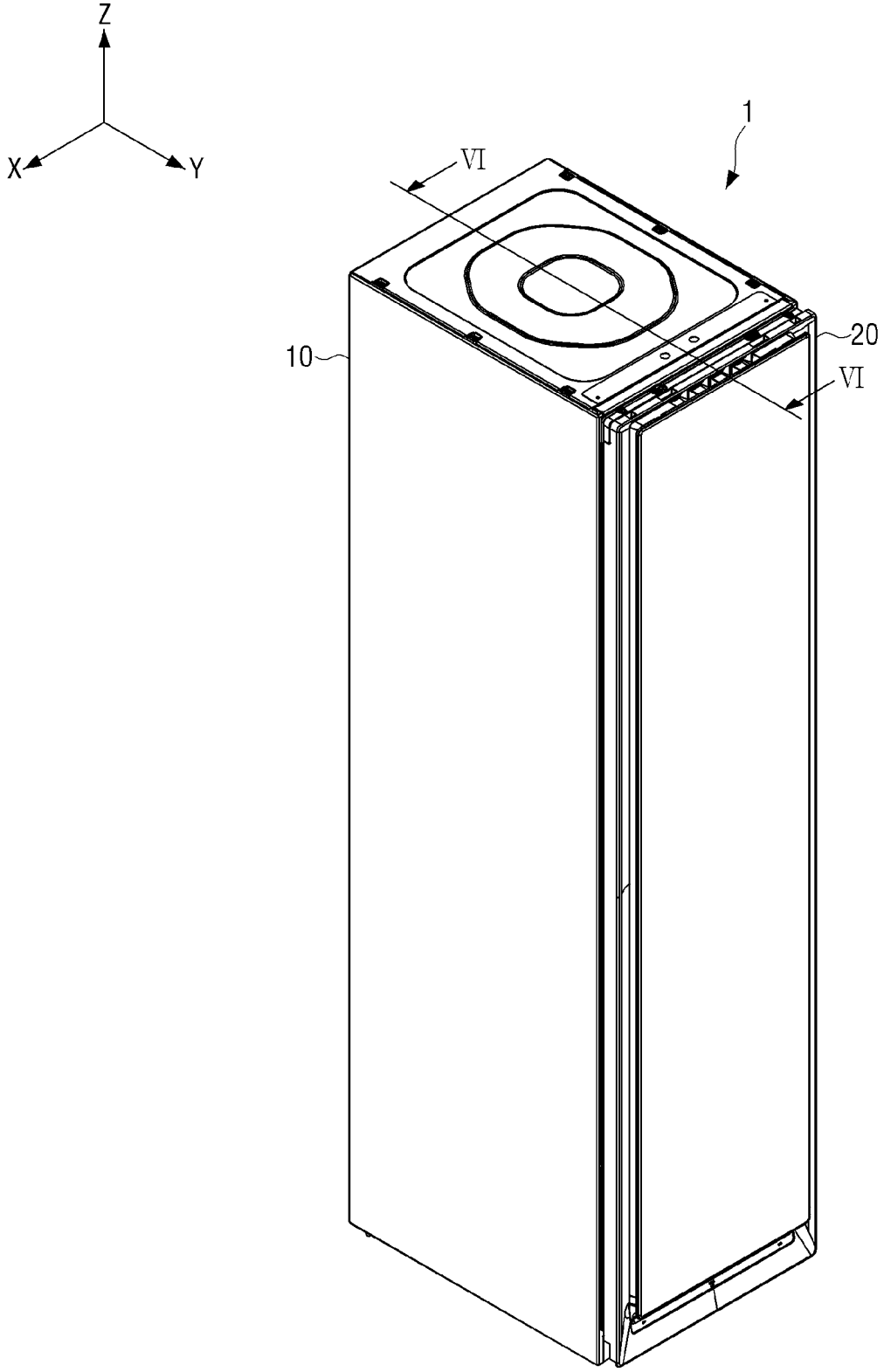
FIG. 1 is a perspective view of a clothing treatment apparatus according to an embodiment.
Figure 2:
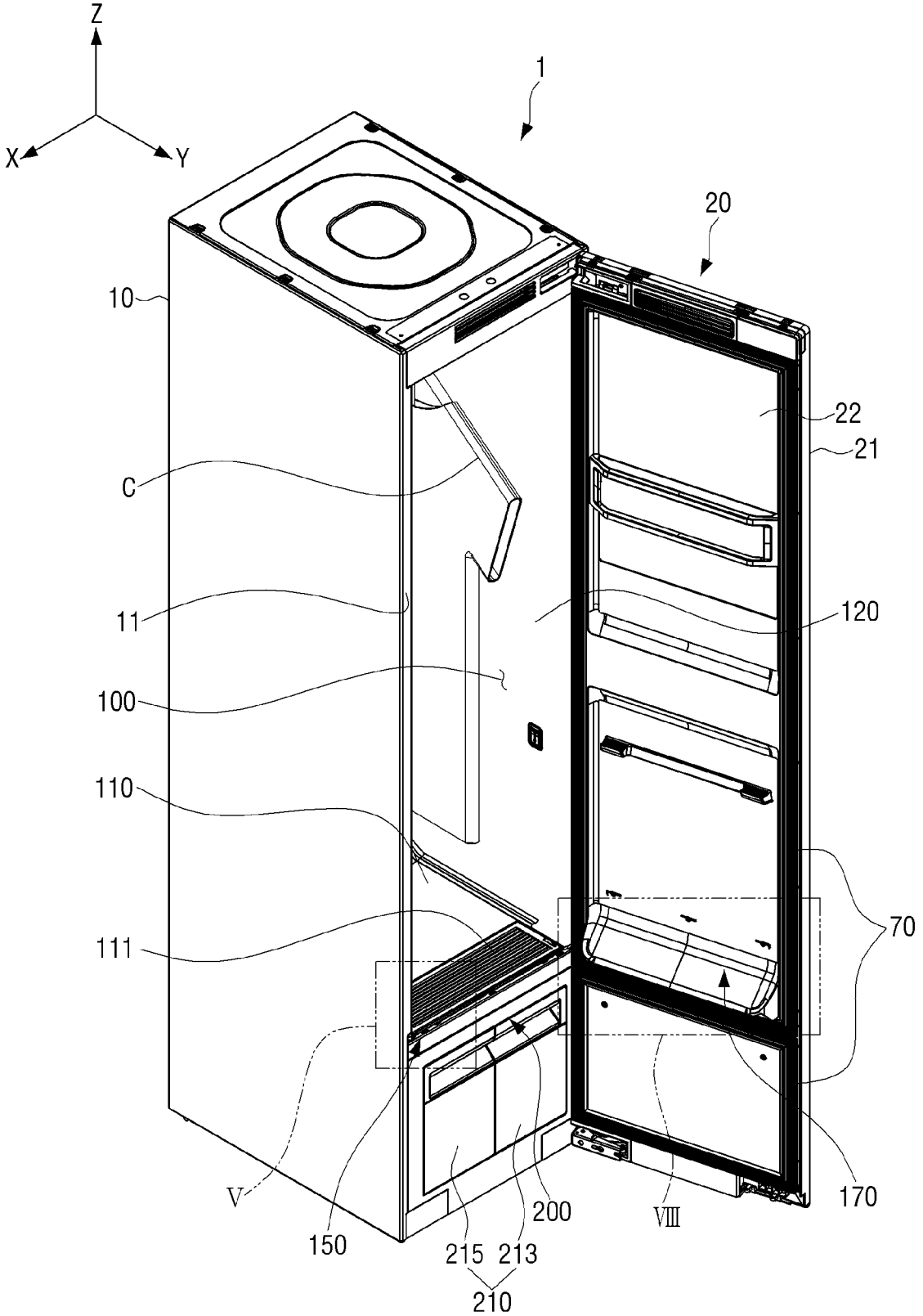
FIG. 2 is a perspective view illustrating a clothing treatment apparatus in a state where a door is open.

FIG. 1 is a perspective view illustrating a clothing treatment apparatus 1 according to an embodiment and FIG. 2 is a perspective view illustrating the clothing treatment apparatus 1 in a state where a door 20 is open.

Referring to FIGS. 1 and 2, the clothing treatment apparatus 1 according to an embodiment of the disclosure may include a main body 10, in which an accommodation chamber 100 and an electric chamber 200 are formed, and a door 20 which is pivotably combined with the main body 10.

The main body 10 may form an appearance of the clothing treatment apparatus 1, and the accommodation chamber 100 in which clothing C is arranged and the electric chamber 200 in which various components for removing wrinkles, odors, moisture, or the like remaining on the clothing by dehumidifying, heating, or circulating the air by circulating the air in the accommodation chamber 100 may be formed therein.

The electric chamber 200 may be configured at a lower portion of the main body 10, that is, a lower portion of the accommodation chamber 100. The accommodation chamber 100 and the electric chamber 200 may be partitioned by a partition wall. The partition wall herein may be defined as a bottom surface 110 of the accommodation chamber.

The electric chamber 200 may include a steam generator 220 for generating air or stream supplied to the accommodation chamber 100, and a water container 210 for supplying water to the steam generator 220 and storing condensate water generated in the accommodation chamber 100.

The internal configuration of the electric chamber 200 will be described later in detail with reference to FIG. 3.

The accommodation chamber 100 may provide a space in which the clothing C is accommodated in the main body 10 and the accommodation chamber 100 may be open or closed by the door 20 provided on the main body 10. The shape of the accommodation chamber 100 may be variously formed, as necessary.

The accommodation chamber 100 may include a plurality of spraying ports (not illustrated) disposed towards the accommodation chamber 100 so that the air or steam discharged from the steam generator 220 is sprayed.

The accommodation chamber 100 may be hermetically closed from the outside except for the plurality of spraying ports, when the clothing treatment apparatus 1 is operated. Accordingly, the wrinkles of the clothing C arranged in the accommodation chamber 100 may be removed and the clothing C may be deodorized with the air or steam sprayed from the plurality of spraying ports in the substantially hermetically closed space.

The plurality of spraying ports may be disposed on each of a bottom surface 110, an inner side surface 120, and an upper surface of the accommodation chamber 100 and may spray the air formed in the steam generator 220 towards the clothing C disposed in the accommodation chamber 100. The plurality of spraying ports may be disposed at various positions in the accommodation chamber 100 according to selection.

The steam or air sprayed by the steam generator 220 may be supplied to the accommodation chamber 100 to treat the clothing accommodated in the accommodation chamber 100. However, since the main body 10 consisting of the accommodation chamber 100 is mainly formed of a metal material, the hot air or steam supplied to the accommodation chamber 100 may come into contact with the inner side surface 120 of the main body 10 having a relatively lower temperature to be condensed, thereby generating condensate water in the accommodation chamber 100.

At a lower side of the accommodation chamber 100, a discharge port 111 for discharging the condensate water generated when the clothing treatment apparatus 1 is operated, to the water container 210 may be provided. The condensate water generated in the accommodation chamber 100 may be stored in the water container 210 via the discharge port 111.

The air or steam discharged from the plurality of spraying ports may come into contact with the inner side surface 120 of the accommodation chamber 100 or an inner side surface of the door 20 having a relatively lower temperature to be condensed, thereby generating condensate water in the accommodation chamber 100. The condensate water generated on the inner side surface 120 of the accommodation chamber or the door 20 by condensation of the air or steam may fall down due to dead weight and fall down onto the bottom surface 110 of the accommodation chamber.

The discharge port 111 for discharging the condensate water to the outside of the accommodation chamber 100 may be formed on the bottom surface 110 of the accommodation chamber where the dropping condensate water is collected. The discharge port 111 may be formed to be connected to a drainage container 215 which will be described later, and accordingly the condensate water discharged via the discharge port 111 may be collected in the drainage container 215.

The discharge port 111 may be formed on the bottom surface 110 of the accommodation chamber to be adjacent to the closed door 20.

In this case, the accommodation chamber 100 may further include a guide member 150 for guiding movement of the condensate water to the discharge port 111 so that the condensate water dropping along the inner side surface 120 of the accommodation chamber or the door 20 does not leak to the outside of the main body 10.

The guide member 150 may be provided between the accommodation chamber 100 and the electric chamber 200. The guide member 150 may be installed on the bottom surface 110 of the accommodation chamber. The guide member 150 may be disposed on a front surface of the accommodation chamber 100 so that a part thereof is exposed.

The guide member 150 may form a flow path for guiding the movement of the condensate water to the discharge port 111 so that the condensate water formed in the accommodation chamber 100 does not leak to the outside of the main body 10. The specific structure of the guide member 150 will be described later with reference to FIG. 4.

The door 20 may be provided on the main body 10 so that the accommodation chamber 100 is able to be open or closed. The door 20 may form one side of the appearance of the clothing treatment apparatus 1 and may partition the outside of the clothing treatment apparatus 1 and the accommodation chamber 100.

Specifically, the door 20 may include a front plate 21 and a rear plate 22 disposed on a rear surface of the front plate 21.

On the front plate 21, a display (not illustrated) for a user to control the operation of the clothing treatment apparatus 1 or control the state of the clothing treatment apparatus 1 may be disposed.

The rear plate 22 may cover all of one side surface of the main body 10 and may be formed with a cross section area larger than that of the front plate 21.

The rear plate 22 may be formed to be spaced apart from the front plate 21 at a certain interval so that the air of the outside enters along an edge of the front plate 21.

A cover member 170 for forming a flow path of the condensate water moving to the discharge port 111 may be disposed on the inner side surface of the rear plate 22.

The cover member 170 may be formed to be protruded towards the accommodation chamber 100. The cover member 170 may form a flow path for guiding the movement of the condensate water generated in the accommodation chamber 100 to the discharge port 111.

The cover member 170 may be formed to be protruded to the side of the discharge port 111 of the accommodation chamber 100 in a biased manner. By such cover member 170, the condensate water formed in the accommodation chamber 100 may flow to the discharge port 111 by moving along the flow path formed by the cover member 170.

The specific structure of the cover member 170 will be described later with reference to FIG. 9.

In addition, a gasket 70 coming into contact with an edge of the main body 10 may be disposed on an edge of the inner side surface of the rear plate 22. The gasket 70 may be adhered to a front outer side surface 11 of the main body 10 to hermetically close the door 20 and the main body 10.

The gasket 70 may be installed to surround the rear plate 22. The gasket 70 may be formed in a bar shape provided along a width direction of the accommodation chamber 100 (X axis direction, width direction of the door) or a height direction of the accommodation chamber 100 (Z axis direction).

The gasket 70 may be provided to cover the front outer side surface 11 of the main body. Specifically, the gasket 70 may be formed to have a width the same or larger than a width of the front outer side surface 11 of the main body.

A part of the gasket 70 may be disposed on a lower side of the cover member 170 to prevent the condensate water falling along the cover member 170 from leaking to the outside of the accommodation chamber 100.

If the door 20 closes the accommodation chamber 100, the gasket 70 disposed on a lower side of the cover member 170 may be overlapped with the guide member 150 to increase a closing force between the accommodation chamber and the door. Accordingly, it is possible to prevent the condensate water generated in the accommodation chamber 100 from leaking to the outside of the main body 10. The specific description of the hermetically closed structure of the gasket 70 and the guide member 150 in a state where the door 20 is closed will be described later with reference to FIG. 7.

Figure 3:
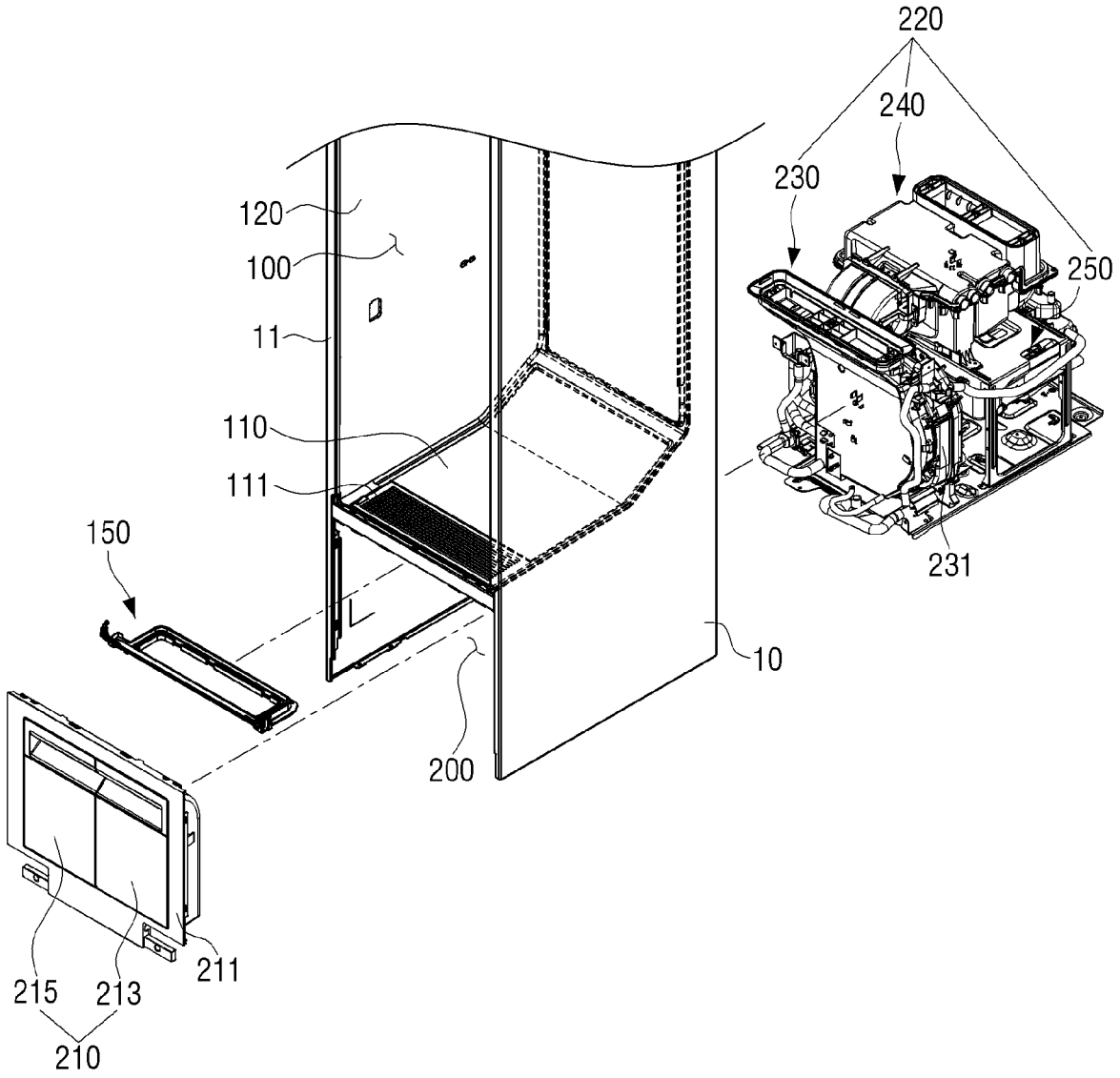
FIG. 3 is an exploded perspective view illustrating a configuration of arrangement in an electric chamber illustrated in FIG. 2.

FIG. 3 is an exploded perspective view illustrating of an electric chamber illustrated in FIG. 2.

Referring to FIG. 3, the electric chamber 200 may include the steam generator 220 for generating steam to be supplied to the accommodation chamber 100 accommodating the clothing, the water container 210 installed in a front portion of the electric chamber 200 to store water, and the guide member 150 installed on the bottom surface 110 of the accommodation chamber.

The steam generator 220 may include a wind blowing device 230 for circulating the air in the accommodation chamber 100, a heat pump 240 for conditioning the air in the accommodation chamber 100, and a steam device 250 for supplying the steam to the accommodation chamber 100.

The steam generator 220 may be defined as an assembly of machine devices for driving each operation of the clothing treatment apparatus 1 such as the air blowing device 230, the heat pump 240, and the steam device 250.

The air blowing device 230 may be installed on a suction side of a blower fan 231 which makes the air flow through rotation to suck the air in the accommodation chamber 100 and discharge the air to the heat pump 240.

The steam device 250 may generate heat by applied power and receive the water from a water supply container 213 which will be described later and convert the water into steam. The water converted into steam may be supplied to the accommodation chamber 100 and flow to the accommodation chamber 100 by the heat pump 240.

The heat pump 240 may be configured with a freezing cycle including a compressor, a condenser, an evaporator, and an expansion valve, and may supply cooled air or heated air into the accommodation chamber 100 according to an operation mode.

The water container 210 may include the water supply container 213 for storing water to be supplied to the steam generator 220 and the drainage container 215 for storing the condensate water generated in the clothing treatment apparatus 1 to drain the condensate water to the outside. In addition, the water container 210 may include a frame 211 for supporting the water supply container 213 and the drainage container 215.

The water container 210 may be installed in front of the steam generator 220 and may include the water supply container 213 connected to the steam device 250 to supply water and the drainage container 215 capable of storing the condensate water discharged from the discharge port 111.

The drainage container 215 may collect and store the condensate water generated in the accommodation chamber 100 and the condensate water generated in the heat pump 240.

The water moved to and stored in the drainage container 215 may be discharged to the outside by separating the drainage container 215 from the electric chamber 200 selectively by a user of the clothing treatment apparatus 1.

The guide member 150 may be formed on one side of the bottom surface 110 of the accommodation chamber and may guide the condensate water generated in the accommodation chamber 100 to move towards the discharge port 111.

The guide member 150 may form a discharge flow path for guiding the condensate to be discharged to the drainage container 215 via the discharge port 111. The condensate water generated in the accommodation chamber 100 may not leak to the front outer side of the main body 10 and may move to the discharge port 111 along the discharge flow path by the guide member 150.

Hereinafter, the specific structure of the guide member 150 will be described.

Figure 4A:
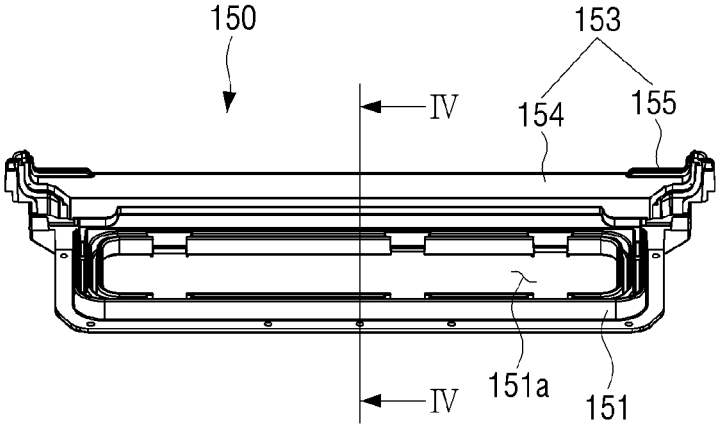
FIG. 4A is a perspective view of a shielding member according to an embodiment.
Figure 4B:
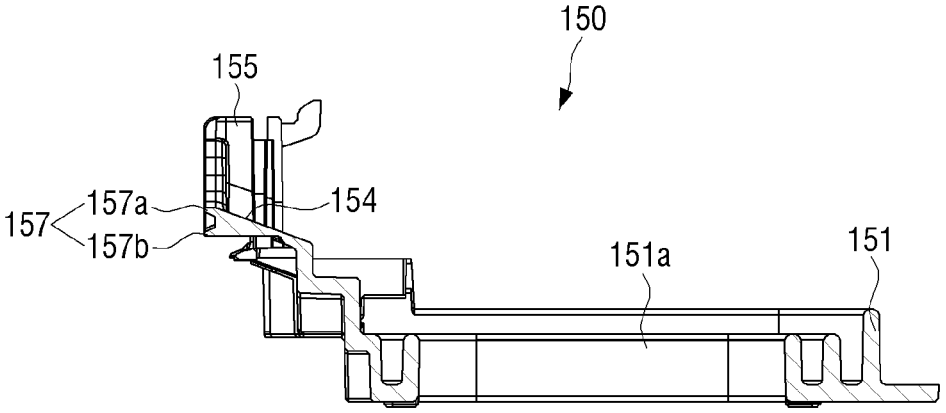
FIG. 4B is a cross-sectional view taken along a line "IV-IV" shown in FIG. 4A.

FIG. 4A is a perspective view of a shielding member according to an embodiment and FIG. 4B is a cross-sectional view taken along a line "IV-IV" shown in FIG. 4A.

Referring to FIGS. 4A and 4B, the guide member 150 may be configured with a discharge part 151 having an opening 151*a* connected to the discharge port 111 and a guide part 153 for guiding the condensate to move to the discharge part 151.

The discharge part 151 may form a flow path for the condensate water guided by the guide part 153 to be discharged to the outside of the accommodation chamber 100. Specifically, the discharge part 151 may form the opening 151*a* communicating with the discharge port 111 therein and may be formed to extend from the guide part 153 in an inner side direction of the main body 10.

The guide part 153 may be configured with a tilt surface 154 forming a tilt downwards to the opening 151*a* of the discharge part 151 and a shielding member 155 formed on one end of the tilt surface 154.

The discharge part 151 may be combined with the bottom surface 110 of the accommodation chamber. The opening 151*a* may be connected to a discharge flow path which is connected to the discharge port 111 of the accommodation chamber 100 in an upper direction and connected to the drainage container 215 in a lower direction.

The condensate water discharged to the discharge port 111 may directly move to the drainage container 215 and move to the drainage container 215 through a separate water collection space.

The tilt surface 154 may be formed to tilt downwards to the opening 151*a*. The tilt surface 154 may move the condensate water moving down to the bottom surface 110 of the accommodation chamber along the inner side surface 120 of the accommodation camber or the rear plate 22 of the door 20 in a direction of the discharge port 111.

In addition, the condensate water falling down along the inner side surface 120 of the accommodation chamber 100 may rapidly move, since the condensate water moves along a flow path formed by the tilt surface 154. The tilt surface 154 may minimize the amount of the condensate water remaining on the accommodation chamber 100 by increasing the flow of the condensate water. By minimizing the condensate water remaining on the accommodation chamber 100, it is possible to increase drying efficiency of the inside of the accommodation chamber 100.

In addition, referring to FIG. 4B, the tilt surface 154 may include a rib 157 formed to extend along a direction opposite to the opening 151*a*. The rib 157 may come into contact with the gasket 70 of the door 20 in a state where the door 20 is closed, thereby increasing the closing force of the accommodation chamber 100.

If the guide member 150 is installed on the accommodation chamber 100, the rib 157 may be formed to be protruded further towards the outer side than the main body 10. The rib 157 may be formed to be protruded towards the door 20 so as to be overlapped with the gasket 70 disposed on the rear plate 22.

The rib 157 may be configured with a first rib 157*a* and a second rib 157*b* disposed to be spaced apart from each other at a predetermined interval. The first rib 157*a* and the second rib 157*b* may be formed to have heights different from each other.

The first rib 157*a* and the second rib 157*b* may seal a gap between the door 20 and the accommodation chamber 100 doubly, thereby increasing closing efficiency.

The shielding member 155 may be formed to be protruded from the tilt surface 154 in an upper direction to have a predetermined height. The shielding member 155 may shield a part of one open side of the accommodation chamber 100 so that the condensate water does not leak to the outside of the accommodation chamber 100.

The shielding member 155 may be formed at both side ends of the guide member 150. A pair of shielding members 155 may be formed to be symmetrical to each other. The shielding member 155 may be formed to be positioned at an edge of the accommodation chamber 100 having a relatively low closing force, thereby increasing a sealing degree of the edge of the accommodation chamber 100.

In addition, the shielding member 155 may guide the condensate water falling down along the inner side surface 120 of the accommodation chamber 100 not to move to the outside of the main body 10. The shielding member 155 may guide the condensate water to the tilt surface 154 to move to the discharge port 111.

The rib 157 may be formed on one surface of the shielding member 155 to extend. The first rib 157*a* and the second rib 157*b* may be formed to extend along one side of the shielding member 155 to be disposed over the one surface of the guide member 150.

The guide member 150 may form the flow path for smoothening the drainage of the condensate water to minimize the amount of the condensate water remaining on the accommodation chamber 100, thereby increasing the drying efficiency in a drying step after spraying the steam of the clothing treatment apparatus.

It is illustrated that the guide member 150 according to an embodiment of the disclosure is separately mounted on a lower end of the accommodation chamber 100, but there is no limitation thereto, and the guide member 150 may be formed on the accommodation chamber 100 integrally with the main body 10.

Figure 5A:
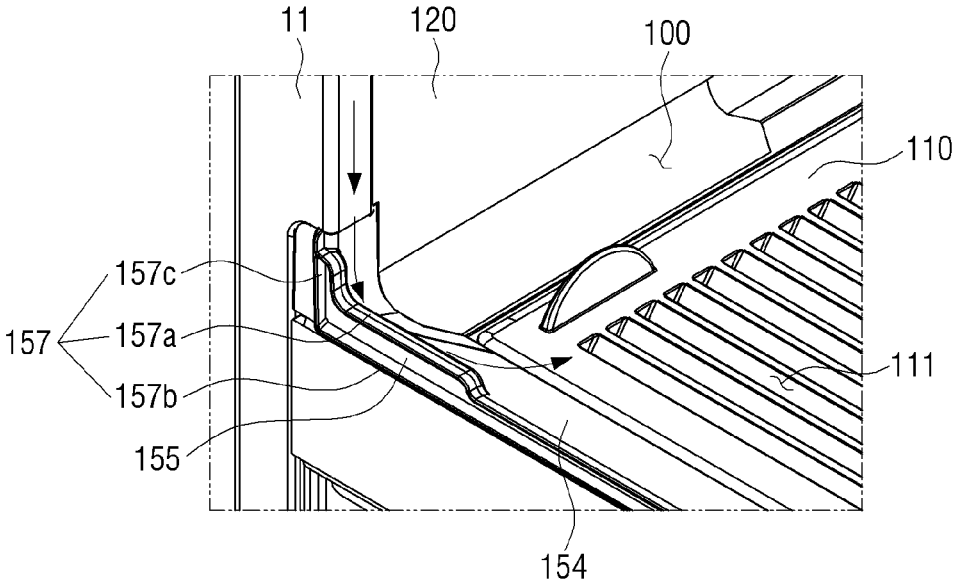
FIG. 5A is an enlarged perspective view illustrating a "V" part shown in FIG. 2 from the front.
Figure 5B:
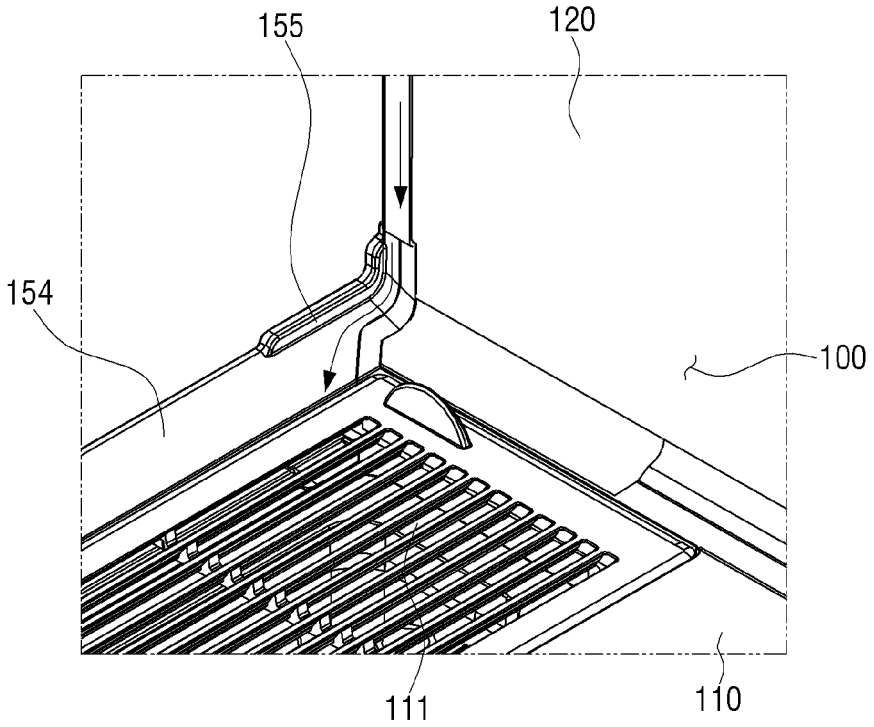
FIG. 5B is an enlarged perspective view illustrating the "V" part shown in FIG. 2 from the back.

FIG. 5A is an enlarged perspective view illustrating a "V" part shown in FIG. 2 from the front and FIG. 5B is an enlarged perspective view illustrating the "V" part shown in FIG. 2 from the back.

Referring to FIGS. 5A and 5B, the guide member 150 may be disposed at one side of the bottom surface 110 of the accommodation chamber to guide the condensate water generated in the accommodation chamber 100 to move towards the discharge port 111. Specifically, if the door 20 closes the accommodation chamber 100, the guide member 150 may be disposed at a position adjacent to the door 20.

The guide member 150 may be disposed so that the guide part 153 is exposed to the accommodation chamber 100. The discharge part 151 of the guide member 150 may be disposed at a lower side of the discharge port 111 of the accommodation chamber 100 so that the discharge port 111 communicates with the opening 151*a*.

The shielding member 155 formed on one end of the tilt surface 154 may be formed at both edges of the bottom surface 110 of the accommodation chamber. The shielding member 155 may prevent leakage in a lower edge region of the accommodation chamber 100 vulnerable to leakage of the condensate water.

The shielding member 155 may be formed to have a predetermined height. The shielding member 155 may be formed to have a level difference. Specifically, the shielding member 155 may be formed so that the level difference is high towards the inner side surface 120 of the accommodation chamber.

The shielding member 155 of the accommodation chamber 100 may shield a water path which may be formed along the outer side surface 11 of the main body and may form a flow path guided to the discharge port 111 along the tilt surface 154. Accordingly, the condensate water generated in the accommodation chamber 100 may fall down along the inner side surface 120 and flow into the accommodation chamber 100 along the flow path, rather than flowing to the outside of the accommodation chamber 100.

The shielding member 155 may be disposed on the edge of the accommodation chamber 100 which is a part vulnerable to leakage, thereby preventing the condensate water from leaking to the outside of the accommodation chamber 100.

The rib 157 may be formed on a front surface of the guide member 150. The rib 157 may be configured with a plurality of ribs, and the rib 157 may be configured with specifically a first rib 157*a* and a second rib 157*b* disposed at a lower end of the first rib 157*a*.

The first rib 157*a* and the second rib 157*b* may be formed along the front surface of the guide member 150 and may also be formed on the front surface of the shielding member 155 to extend. The first rib 157*a* and the second rib 157*b* may be formed at a predetermined interval to come into contact with the gasket 70 of the door 20, thereby doubly sealing the accommodation chamber 100.

In addition, the rib 157 may further include a side surface rib 157*c* formed on a side surface. The side surface rib 157*c* may be provided to additionally seal the side surface of the accommodation chamber 100.

The plurality of ribs 157 may be formed to be protruded to the outside of the main body 10 by a predetermined length. The rib 157 formed to be protruded from the main body 10 may increase combination force with the door 20, thereby increasing closing force of the accommodation chamber 100.

The tilt surface 154 tilting downwards to the discharge port 111 may be formed on the bottom surface 110 of the accommodation chamber. The tilt surface 154 may be formed on one open side of the accommodation chamber 100 so as to prevent the condensate water from leaking to the outside of the accommodation chamber 100.

A flow path for discharging the condensate water to the discharge port 111 may be formed on the accommodation chamber 100 by the shielding member 155 and the tilt surface 154. The condensate water falling down along the inner side surface 120 of the accommodation chamber 100 may flow towards the discharge port 111, rather than being discharged to the outside of the accommodation chamber 100.

In the accommodation chamber 100, the condensate water may fall down to the bottom surface 110 to enter the discharge port 111, and particularly, the condensate water may flow down to the side of the discharge port 111 along the tilt surface 154, thereby actively performing the discharge operation of the discharge port 111. At least a part of the tilt surface 154 may be positioned on a lower side of the inner side surface 120 so that the condensate water flowing down along the inner side surface 120 falls down thereon.

The shielding member 155 and the tilt surface 154 may form a flow path so that a large amount of the condensate water is smoothly drained.

The flow path of the condensate water may be formed on a lower edge of the accommodation chamber 100 which is most vulnerable to the leakage, thereby minimizing the amount of the condensate water moving to the edge of the accommodation chamber 100, and the shielding member 155 and the tilt surface 154 may guide the condensate water moving to the edge to move to the inside of the accommodation chamber 100 and to be discharged to the discharge port 111, thereby preventing a phenomenon of leakage of the condensate water to outside.

The tilt surface 154 may guide, not only the condensate water flowing down along the inner side surface 120 of the accommodation chamber 100, but also the condensate water flowing down along the door 20, to flow towards the discharge port 111 along the tilt surface 154.

Figure 6:
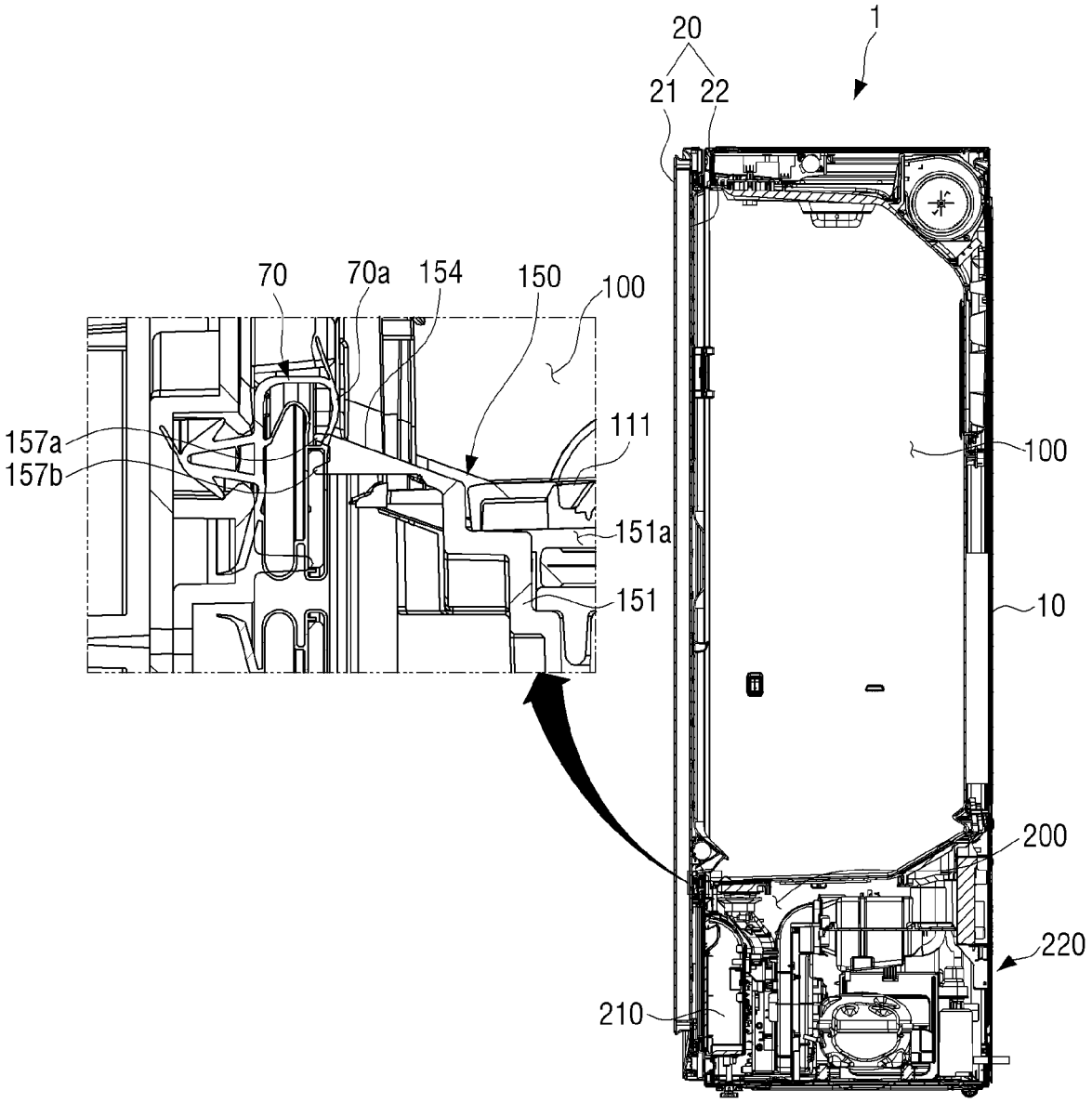
FIG. 6 is a cross-sectional view taken along a line "VII-VII" shown in FIG. 1.

FIG. 6 is a cross-sectional view taken along a line "VII-VII" shown in FIG. 1 and illustrates an enlarged part where the guide member 150 comes into contact with the gasket 70 of the door 20.

Referring to FIG. 6, if the door 20 presses the main body 10 to close the accommodation chamber 100, the rib 157 formed on the front surface of the main body 10 to be protruded may be overlapped with the gasket 70 disposed on the rear plate 22. The rib 157 may be overlapped with the inner side surface of the gasket 70 to press the gasket 70.

The rib 157 and the gasket 70 may form a contact surface to shield the condensate water which may leak therein.

The plurality of ribs 157 may be formed on the front surface of the main body with heights different from each other. Since each of the first rib 157*a* and the second rib 157*b* formed at heights different from each other forms a contact point with the gasket 70, the accommodation chamber 100 may be doubly sealed by the plurality of contact surface.

If the first rib 157*a* is overlapped with the gasket 70, a protruded part 70*b* of the gasket may be positioned on an upper side of the first rib 157*a*. A part of the condensate water flowing along the door 20 may be guided to the tilt surface 154 by the protruded part 70*b* and discharged to the discharge port 111 along the tilt surface 154.

The protruded part 70*b* of the gasket 70 may form the flow path for the condensate water to be discharged to the discharge port 111 by the first rib 157*a*. The condensate water flowing down along the protruded part 70*b* may flow towards the discharge port 111 along the tilt surface 154 via the flow path, rather than being discharged to the outside of the accommodation chamber 100.

The second rib 157*b* may be disposed on a lower end of the first rib 157*a* to secondarily seal the condensate water which may leak from the first rib 157*a*. The second rib 157*b* may also press the gasket 70 to increase the sealing efficiency, in the same manner as the first rib 157*a*.

As the overlapped area of the rib 157 and the gasket 70 increases, the accommodation chamber 100 may be more stably sealed.

The external leakage may be prevented by doubly sealing the lower part of the accommodation chamber, which is most vulnerable to the leakage, by the protruded ribs formed doubly.

It is described that the rib 157 is formed on the guide member 150, but there is no limitation thereto and the rib may be formed to protruded from the front surface of the main body 10.

Figure 7:
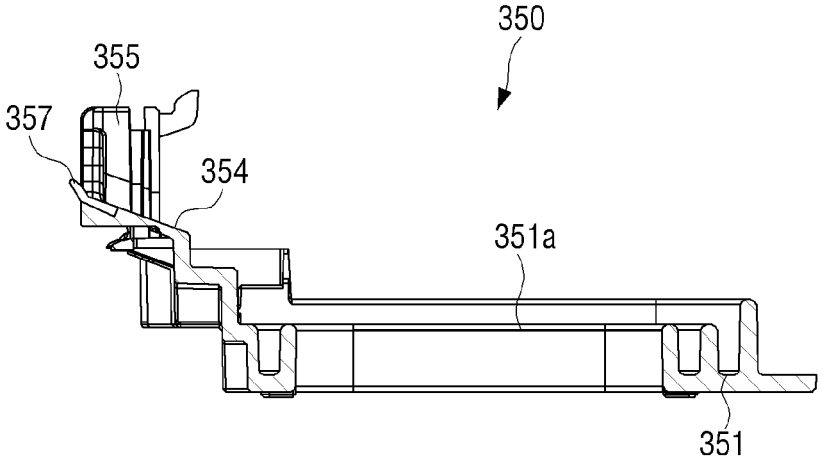
FIG. 7 is a cross-sectional view of a shielding member according to another embodiment.

FIG. 7 is a cross-sectional view of a shielding member according to another embodiment.

Referring to FIG. 7, a guide member 350 according to another embodiment of the disclosure may have substantially the same configuration as the guide member 150 described with reference to FIG. 4B. However, the guide member 350 is different in that a rib 357 is formed as a separate elastic member. Accordingly, the specific description of the configuration of the guide member 350 according to another embodiment of the disclosure that is overlapped with the guide member 150 described with reference to FIG. 4B will not be repeated.

The guide member 350 may be configured with a discharge part 351 and a guide part 353.

The guide part 353 may be configured with a tilt surface 354 tilting downwards to an opening 351*a* of the discharge part 351 and a shielding member 355 formed at one end of the tilt surface 354.

The rib 357 formed to extend in a direction opposite to the opening 351*a* may be included on the front surface of the guide part 353. The rib 357 may be disposed at one side of the tilt surface 354. The rib 357 may be formed of a separate member having a soft or hard elastic material. The rib 357 may be formed of a material similar to the gasket 70 of the door 20. The rib 357 may increase the closing force of the accommodation chamber 100.

If the guide member 350 is installed on the accommodation chamber 100, the rib 357 may be formed to be protruded to outside further than the main body 10. The rib 357 may be formed to be protruded to the door 20 so as to be overlapped with the gasket 70 disposed on the rear plate 22 of the door.

A groove, in which the rib 357 is to be disposed, may be formed at one side of the tilt surface 354. The rib 357 may be fixed on the groove formed on the tilt surface 354.

The rib 357 may form a protruded structure by inserting a soft or hard material to the guide member 350 so as to be formed to be protruded on the front surface of the main body 10.

The guide member 350 may include the rib 357 to increase the closing force of a lower part of the accommodation chamber 100. The leakage may be prevented by sealing the lower part of the accommodation chamber 100, which is vulnerable to the leakage, by the rib 357.

Figure 8A:
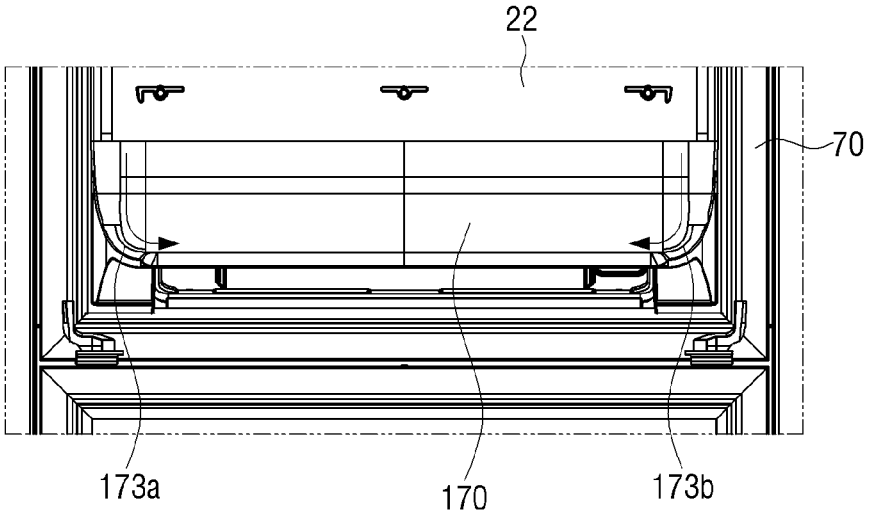
FIG. 8A is an enlarged front view of a cover member according to an embodiment.
Figure 8B:
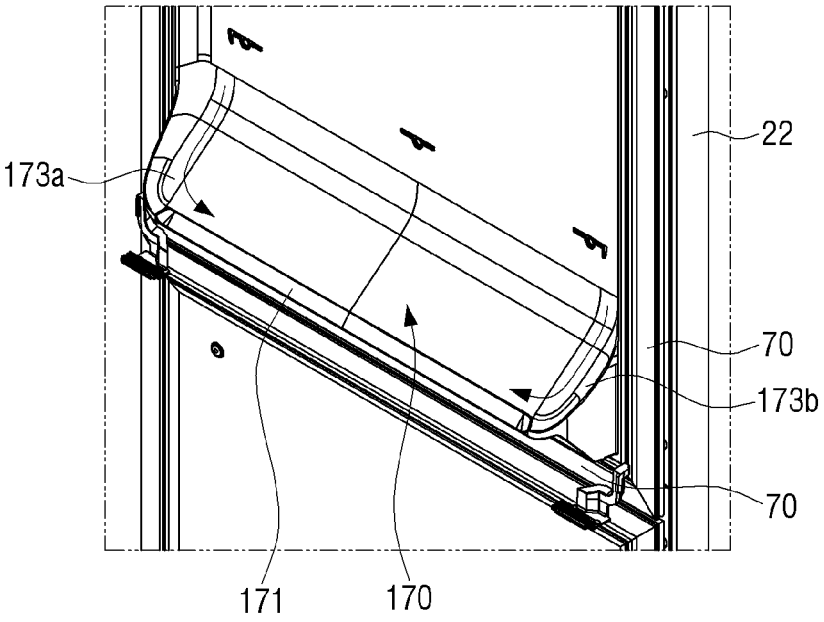
FIG. 8B is an enlarged perspective view of a cover member.

FIG. 8A is an enlarged front view of a cover member according to an embodiment and FIG. 8B is an enlarged perspective view of a cover member.

Referring to FIGS. 8A and 8B, the door 20 may include a cover member 23 combined to one surface of the rear plate 22. The cover member 170 may be integrally formed with the rear plate 22.

The cover member 170 may be formed to be protruded to a side of the accommodation chamber 100 in a biased manner. If the door 20 closes the accommodation chamber 100, the cover member 170 may be disposed on one surface of the door 20 so as to be positioned on a lower portion of the accommodation chamber 100.

The cover member 170 may be formed to tilt downwards to the discharge port 111.

A drop part 171 having an undercut shape so that the condensate water is formed thereon and easily falls down may be formed on a lower end of the cover member 170. The drop part 171 may be disposed on the discharge port 111 formed on the bottom surface 110 of the accommodation chamber. Accordingly, the condensate water falling down from the drop part 171 may move to the discharge port 111.

Curved parts 173*a* and 173*b* for guiding the condensate water to the inside of the cover member 170 may be formed on both ends of the cover member 170. The curved parts 173*a* and 173*b* may be formed to be symmetrical to each other.

The curved parts 173*a* and 173*b* may be formed to extend from both ends of the drop part 171 in a direction of the rear plate 22 so that the condensate water does not fall down to the edge of the accommodation chamber 100 but fall down to the inside of the accommodation chamber 100.

The curved parts 173*a* and 173*b* may be formed in a curved shape towards the center to guide the condensate water to move to the center of the cover member 170. Specifically, the curved parts 173*a* and 173*b* may be formed to be protruded from both ends of the cover member 170 and may be formed to tilt to the inside of the cover member 170.

The curved parts 173*a* and 173*b* may form a flow path in which the condensate water falling down to both ends of the cover member 170 is not scattered to the right and left but flows to the inside of the cover member 170. The condensate water falling down along the rear plate 22 may be collected in the inner portion of the cover member 170 along the tilt of the curved parts 173*a* and 173*b* and fall down to the drop part 171.

The curved parts 173*a* and 173*b* may prevent the condensate water flowing down along the rear plate 22 from flowing to both ends of the cover member 170 and guide the condensate water to the drop part 171.

Even if the condensate water drops down to the curved parts 173*a* and 173*b*, the condensate water flows to the drop part 171 due to the tilt, thereby preventing the condensate water from flowing to the outside of the accommodation chamber 100.

The gasket 70 may be formed on the lower side of the cover member 170 to prevent the condensate water falling down from the cover member 170 from flowing to the outside of the accommodation chamber 100.

In addition, the condensate water moving along the inner side surface of the door 20 may move rapidly, since the condensate water moves along the flow path formed by the cover member 170. The cover member 170 may increase the flow rate of the condensate water to minimize the amount of the condensate water remaining on the door 20. It is possible to increase the drying efficiency of the inside of the accommodation chamber 100 by minimizing the condensate water remaining on the door 20.

The cover member 170 may form the flow path for making the drainage of the condensate water smooth to minimize the amount of the condensate water remaining in the accommodation chamber 100, thereby increasing the drying efficiency in the drying step after spraying the steam of the clothing treatment apparatus.

The disclosure has been described above by the exemplary method. The terms used herein are merely for the description and should not be limitedly interpreted. Various modifications and changes of the disclosure may be performed according to the content described above. Therefore, the disclosure can be practiced freely within the scope of the claims, unless otherwise noted.

What is claimed is:

1. A clothing treatment apparatus comprising:

a main body configured to include an accommodation chamber for accommodation clothing, wherein the accommodation chamber comprises a guide member;

a door configured to open or close the main body, the door comprising a gasket configured to contact the guide member along a width of the door;

a spraying port configured to spray steam toward clothing accommodated in the accommodation chamber; and a steam generator configured to supply steam to the spraying port, wherein the accommodation chamber comprises a flow path for guiding movement of condensate water generated in the accommodation chamber.

2. The clothing treatment apparatus according to claim 1, wherein a discharge port for discharging the condensate water is formed on a bottom surface of the accommodation chamber, and wherein one end of the flow path is connected to the discharge port.

3. The clothing treatment apparatus according to claim 2, wherein the accommodation chamber comprises a guide member disposed on a bottom of the accommodation chamber, and wherein the guide member is configured to guide the condensate water falling down along an inner side surface of the accommodation chamber to move to the discharge port.

4. The clothing treatment apparatus according to claim 3, wherein the guide member comprises:

a tilt surface tilting downwards to the discharge port; and a rib formed on a front surface of an upper portion of the tilt surface and formed to extend in a direction of the door.

5. The clothing treatment apparatus according to claim 4, wherein the rib is formed to protruded to an outer side surface of the main body.

6. The clothing treatment apparatus according to claim 4, wherein the door comprises a gasket configured to be disposed on an inner side surface of the door, and based on the door being closed, be overlapped with the rib to shield leakage of the condensate water.

7. The clothing treatment apparatus according to claim 6, wherein the gasket, based on the door being closed, is disposed on the door so as to surround the accommodation chamber.

8. The clothing treatment apparatus according to claim 4, wherein the rib comprises a first rib and a second rib formed to be protruded to a front surface of the tilt surface with heights different from each other.

9. The clothing treatment apparatus according to claim 4, wherein the guide member further comprises a shielding member disposed on one end of the tilt surface opposing the discharge port and formed to be protruded upwards from the tilt surface.

10. The clothing treatment apparatus according to claim 9, wherein the shielding member is disposed symmetrically on both side ends of the guide member.

11. The clothing treatment apparatus according to claim 9, wherein the rib is formed to extend from a front surface of the shielding member.

12. The clothing treatment apparatus according to claim 2, wherein the door further comprises a cover member formed to be protruded towards the accommodation chamber, and wherein the cover member guides condensate water falling down along an inner side surface of the door to move to the discharge port.

13. The clothing treatment apparatus according to claim 12, wherein the cover member comprises a drop part formed on a lower end in an undercut shape.

14. The clothing treatment apparatus according to claim 13, wherein the cover member further comprises a curved part which is formed on both ends of the cover member and tilts to inside of the curved part to guide the condensate water to the drop part.

15. The clothing treatment apparatus according to claim 12, wherein the cover member is formed to tilt downwards to the discharge port, based on the door being closed.

* * * * *